US006445121B1

(12) United States Patent
Roes et al.

(10) Patent No.: US 6,445,121 B1
(45) Date of Patent: Sep. 3, 2002

(54) LOW-PRESSURE MERCURY VAPOR DISCHARGE LAMP WITH A SPIRAL-SHAPED ELECTRODE SHIELD

(75) Inventors: Johannes H. Roes; Adrianus J. H. P. Van Der Pol, both of Eindhoven (NL)

(73) Assignee: Koninklüke Phillips Electronics NY, Eindhoven (NL)

( * ) Notice: Subject to any disclaimer, the term of this patent is extended or adjusted under 35 U.S.C. 154(b) by 0 days.

(21) Appl. No.: 09/411,462

(22) Filed: Oct. 1, 1999

(30) Foreign Application Priority Data

Oct. 23, 1998 (EP) ..... 98203583

(51) Int. Cl.[7] ..... H01J 61/10
(52) U.S. Cl. ..... 313/492; 313/240; 313/613
(58) Field of Search ..... 313/313, 492, 313/146, 567, 613, 614, 615, 592, 240

(56) References Cited

U.S. PATENT DOCUMENTS 2,011,981 A * 8/1935 Mulder ..... 313/592
3,798,485 A * 3/1974 Witting ..... 313/205
5,841,222 A * 11/1998 Heuvelmans et al. ..... 313/345
6,107,737 A * 8/2000 della Porta ..... 313/556

FOREIGN PATENT DOCUMENTS

JP 1131475 2/1999 ..... H01J/61/067

OTHER PUBLICATIONS

J.P. Kokai 62–208536, Dec. 9, 1987, Abstract (English Language).
JP 11031475—Abstract Feb. 1999.
J.P. Kokai 62–208536, Dec. 9, 1987, Abstract (English Language).
JP 11031475—Abstract Feb. 2, 1999.

* cited by examiner

*Primary Examiner*—Michael H. Day
(74) *Attorney, Agent, or Firm*—Dicran Halajian; Frank J. Keegan

(57) ABSTRACT

The discharge vessel encloses a discharge space provided with a filling of mercury and a rare gas in a gastight manner. Each end portion (12*a*) of the lamp supports an electrode (20*a*) arranged in the discharge space. An electrode shield (22*a*) encompasses at least one of the electrodes (20*a*) and has a substantially spiral-shaped cross-section. Preferably, the electrode shield (22*a*) is made from a ceramic material and is covered with a material which reacts with or forms an alloy with alkaline earth metals released by the electrode (20*a*).

17 Claims, 4 Drawing Sheets

LOW-PRESSURE MERCURY VAPOR DISCHARGE LAMP WITH A SPIRAL-SHAPED ELECTRODE SHIELD

BACKGROUND OF THE INVENTION

The invention relates to a low-pressure mercury vapor discharge lamp provided with a discharge vessel, which discharge vessel surrounds in a gastight manner a discharge space provided with a filling of mercury and a rare gas, electrodes being arranged in the discharge space for generating and maintaining a discharge in the discharge space, and an electrode shield surrounding at least one of the electrodes at least substantially.

Mercury is the primary component for an (efficient) generation of ultraviolet (UV) light in mercury vapor discharge lamps. A luminescent layer comprising a luminescent material (for example, a fluorescent powder) may be present on an inside wall of the discharge vessel for the conversion of UV to other wavelengths, for example to UV-B and UV-A for sun tanning purposes (sun couch lamps) or to visible radiation for general lighting purposes. Such discharge lamps are accordingly also referred to as fluorescent lamps. The discharge vessel of a low-pressure mercury vapor discharge lamp is usually circular in shape and there are both elongate and compact embodiments. In general, the tubular discharge vessel of so-called compact fluorescent lamps comprises a set of comparatively short straight portions of comparatively small diameter, which straight portions are interconnected either by means of bridge portions or by means of curved portions. Compact fluorescent lamps are usually provided with (integrated) lamp caps.

A low-pressure mercury vapor discharge lamp of the kind mentioned in the opening paragraph is known from the English abstract of Japanese patent application JP-A 62-208 536. In the known lamp, the electrode shield surrounding the electrode is cylindrical in shape and is provided with a narrow opening in the direction of the so-called positive column. The known electrode shield is manufactured from glass and is electrically insulated from the electrode. The use of the known electrode shield, also called anode shield or cathode shield, achieves that a portion of the high-energy electrons in the so-called negative glow recombines at an inner surface of the electrode shield, while a further portion of these electrodes diffuses through the opening. As a result of this, the negative glow and the positive column are coupled to one another, and the efficiency of the known discharge lamp is improved.

A disadvantage of the use of the known low-pressure mercury vapor discharge lamp is that its mercury consumption is comparatively high. As a result of this, a comparatively high mercury dose is necessary for the known lamp if a sufficiently long life is to be realized. This is detrimental to the environment in the case of inexpert processing after the end of lamp life.

SUMMARY OF THE INVENTION

The invention has for its object to provide a low-pressure mercury vapor discharge lamp which consumes comparatively little mercury.

To achieve this, the electrode shield has the shape of a snail shell.

To achieve a good operation of low-pressure mercury vapor discharge lamps, the electrodes of such discharge lamps comprise not only a material with a high melting point (a widely used metal is tungsten), but also an (emitter) material with a low so-called work function (reduced emission potential) for supplying electrons to the discharge (by emission, cathode function) and for receiving electrons from the discharge (anode function). Known emitter materials with a low work function are, for example, oxides of alkaline earth metals. It is observed that (emitter) material is released during operation of such low-pressure mercury vapor discharge lamps, for example owing to evaporation or sputtering of the alkaline earth metals from the electrode(s). It is found in general that these materials are deposited on an inside wall of the discharge vessel. It is further found that the alkaline earth metals deposited elsewhere in the discharge vessel no longer take any part in the process of light generation. The deposited (emitter) material causes so-called blackening (a greying effect) during lamp life, which is often visible in the form of blackish rings adjacent the electrodes of the low-pressure mercury vapor discharge lamp. Such a blackening is undesirable for aesthetic reasons. Chemical analysis also shows that mercury-containing amalgams are formed on the inside wall in the blackening spots. The quantity of mercury available for the discharge is (gradually) reduced owing to the formation of these mercury amalgams, which adversely affects lamp life. To counteract such a loss of mercury during lamp life, a comparatively high mercury dose is necessary in the lamp, which is undesirable for environmental reasons.

An additional advantage of the use of an electrode shield in the form of a snail shell is that the reduction of the blackening on the inside wall of the discharge vessel improves the lumen output during the useful life of the discharge lamp compared with that of the known discharge lamp.

In the known low-pressure mercury vapor discharge lamp, the mercury absorption in the region around the electrode is reduced by the presence of the cylindrical electrode shield. The presence, however, of the comparatively large opening in the known electrode shield, facing towards the discharge space (the direction of the positive column) still renders it possible for a considerable portion of the emitter material released during the operation of the discharge lamp to be deposited on the inside wall of the discharge vessel.

When an electrode shield in the shape of a snail shell is used in the low-pressure mercury vapor discharge lamp according to the invention, the (emitter material on the) electrode is entirely overshadowed by the electrode shield, as seen in the direction of the discharge space. Such an electrode shield in the shape of a snail shell achieves as it were that the electrode does not have a direct "view" of the inside wall of the discharge vessel, looking in the direction of the discharge space. The measure according to the invention considerably reduces the risk of material emitted by the electrode in the direction of the discharge space during operation becoming deposited on the inside wall of the discharge vessel.

It is particularly favorable when the electrode shield is substantially spiral-shaped in cross-section. Such a spiraling electrode shield provides a good passage for the discharge from the electrode to the discharge space. Furthermore, a spiraling electrode shield is easy to manufacture.

The passage of the discharge from the electrode to the discharge space extends through the revolutions of the spiral-wound electrode shield. Provided the spiral comprises at least one full revolution, the electrode will not "see" the wall of the discharge vessel anywhere in the direction to the discharge space, in other words, the risk of emitter material being deposited on the wall of the discharge vessel is considerably reduced.

Preferably the electrode shield has a narrow opening, the size of said opening being adapted so as to allow the electrode to pass through. The advantage of this measure is that the electrode shield can be provided around the electrode in the manufacture of the discharge lamp when the electrode has already been mounted (for example by means of a welding operation) on the so-called mount, which comprises current supply conductors which are passed through end portions of the discharge lamp to outside the discharge vessel.

Preferably at least one electrode comprises an alkaline earth metal which is partly released from the electrode during operation, and the electrode shield comprises a material which reacts with or forms an alloy with the alkaline earth metal originating from the at least one electrode. It is found from experiments that the alkaline earth metals in metallic form form amalgams with mercury, and that oxides of alkaline earth metals do not react with mercury. Thus, alkaline earth metals in the form of, for example, BaO, SrO, $Ba_3WO_6$, $Sr_3WO_4$, etc., do not form amalgams with mercury, whereas metallic alkaline earth metals do combine with mercury, forming, for example, Ba—Hg or Sr—Hg amalgams under similar circumstances. The provision of an electrode shield comprising a material which reacts with or forms an alloy with the alkaline earth metal originating from the electrode(s) considerably reduces the risk of mercury amalgamating, so that the mercury remains available for the discharge and the mercury consumption of the discharge lamp is reduced.

The electrode shield preferably comprises an oxide of a material which oxidizes the alkaline earth metal. The mercury consumption of the discharge lamp is reduced in that the alkaline earth metals originating from the electrodes and deposited on the electrode shield change their chemical state from metallic to that of a suitable metal oxide. Suitable materials are oxidic materials having more than one oxidation state, the material not being in its lowest oxidation state. Further suitable materials are materials having an oxygen deficit. Preferably, the alkaline earth metal is barium or strontium, and the oxide is chosen from the group formed by $MnO_2$, $TiO_2$, $Fe_2O_3$, $In_2O_3$, $SnO_2$, $SnO_2$:Sb, $ZrO_2$, $Nb_2O_5$, $V_2O_5$, $Tb_4O_7$, and ZnO. Contact with metallic alkaline earth metal (from the electrode) will lead to the formation of the corresponding oxide of the alkaline earth metal, i.e. BaO and/or SrO.

The electrode shield itself must not absorb an appreciable quantity of mercury. To this end, the material of the electrode shield comprises, for example, at least an oxide of at least one element from the series formed by magnesium, silicon, aluminum, titanium, zirconium, yttrium, and the rare earths, or the electrode shield is manufactured from a metal, for example iron or titanium. Preferably, the electrode shield is manufactured from a ceramic material comprising aluminium oxide. A particularly suitable electrode shield is one which was manufactured from densely sintered $A1_2O_3$, also referred to as PCA (PolyCrystalline Alumina). An additional advantage of the use of aluminum oxide is that an electrode shield manufactured from such a material is resistant to comparatively high temperatures (>250° C.). The risk of the (mechanical) strength of the electrode shield being impaired increases at such comparatively high temperatures, whereby the permanence of shape of the electrode shield is adversely affected. Material (i.e. emitter) originating from the electrode(s) and deposited on an electrode shield manufactured from aluminum oxide which is at such a considerably raised temperature is not or substantially not capable of reacting with mercury present in the discharge as a result of this raised temperature, so that the formation of mercury amalgams is at least substantially prevented. The use of a ceramic electrode shield in the shape of a snail shell according to the invention thus serves a dual purpose. On the one hand, it is effectively counteracted that material originating from the electrode(s) is deposited on the inside wall of the discharge vessel, while on the other hand it is counteracted that (emitter) material deposited on the electrode shield forms amalgams with mercury present in the discharge lamp. Preferably, a temperature of the electrode shield is higher than 250° C. during operation. An advantage of such a comparatively high temperature is that the electrode shield becomes hotter than in the known lamp, especially in the initial phase, as a result of which any mercury still bound to the electrode shield is released more quickly and easily.

A further advantage of the use of an electrode shield of aluminum oxide in the shape of a snail shell arises in lamps which are operated on a controllable ballast, for example a so-called high-frequency regulating (HFR) dimming ballast, where an excessive evaporation of (emitter) material of the electrode may take place especially at reduced light levels, while the electrode under these conditions is usually given additional heating through the use of a "bias" current. The electrode shield will catch this material and achieve that the formation of amalgams is effectively counteracted. The mercury consumption of the low-pressure mercury vapor discharge lamp is reduced thereby.

The use of a ceramic electrode shield further reduces the reactivity of materials in the electrode shields, i.e. their tendency to react with mercury present in the discharge vessel for forming amalgams (Hg—Ba, Hg—Sr). The use of an electrically insulating material in addition prevents short-circuiting of the lead wires of the electrode(s) and/or short-circuiting of a number of turns of the electrode(s).

The shape of the electrode shield and its positioning with respect to the electrode influence the temperature of the electrode shield. Preferably, an axis of symmetry of the electrode shield is at least substantially parallel to or coincides substantially with the longitudinal axis of the electrode.

BRIEF DESCRIPTION OF THE DRAWINGS

The Figures are purely diagrammatic and not drawn true to scale. Some dimensions have been particularly exaggerated for reasons of clarity. Equivalent components have been given the same reference numerals as much as possible in the Figures.

DETAILED DESCRIPTION OF THE PREFERRED EMBODIMENTS

Figure 1:
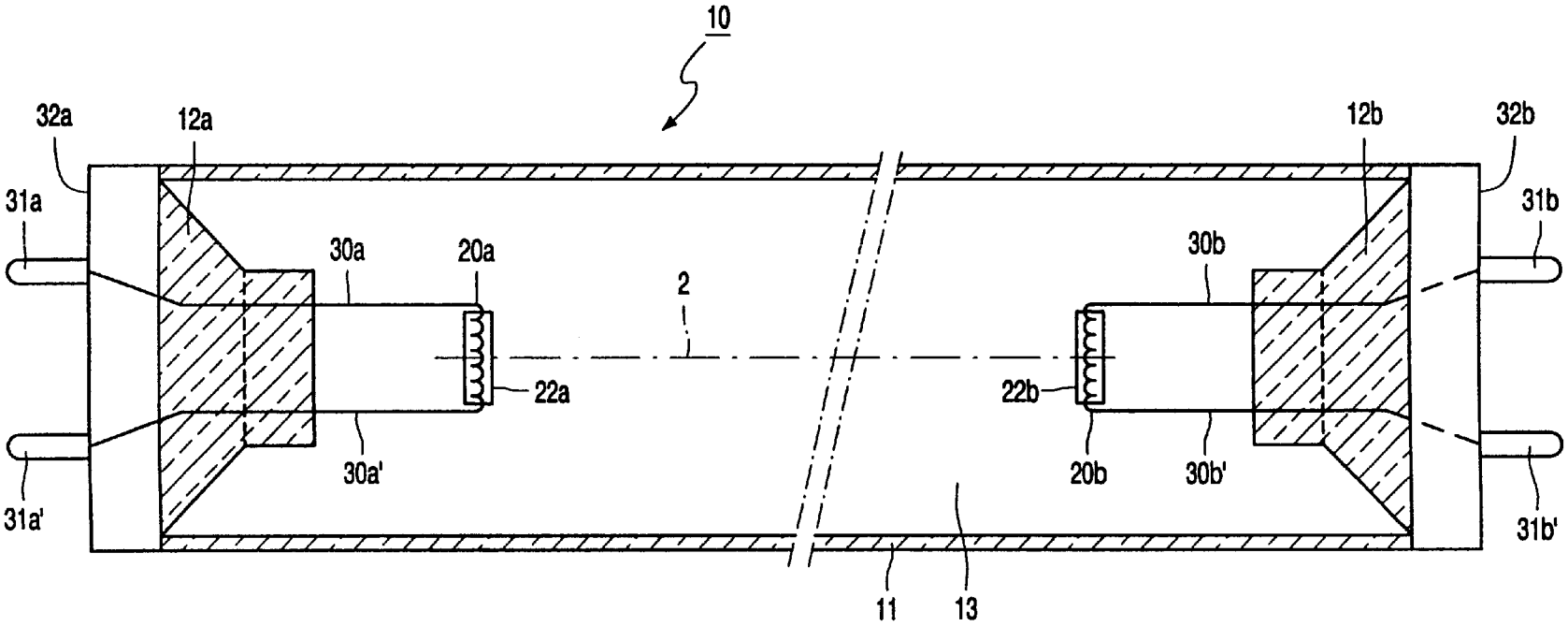
FIG. 1 shows an embodiment of the low-pressure mercury vapor discharge lamp according to the invention in longitudinal sectional view.

FIG. 1 shows a low-pressure mercury vapor discharge lamp provided with a glass discharge vessel 10 with a tubular portion 11 around a longitudinal axis 2, which discharge vessel transmits radiation generated in the discharge vessel 10 and is provided with a first and a second end portion 12*a*; 12*b*. The tubular portion 11 in this example has a length of 120 cm and an internal diameter of 24 mm. The discharge vessel 10 encloses a discharge space 13 provided with a filling of mercury and a rare gas, for example argon, in a gastight manner. The wall of the tubular portion is usually coated with a luminescent layer (not shown in FIG. 1) comprising a luminescent material (for example, a fluorescent powder) which converts the ultraviolet (UV) radiation generated by a return to the ground state of the excited mercury into (usually) visible light. The end portions 12*a*; 12*b* each support an electrode 20*a*; 20*b* arranged in the discharge space 13. The electrode 20*a*; 20*b* comprises a winding of tungsten which is coated with an electron-emitting substance, in this case a mixture of oxides of barium, calcium, and strontium. Current supply conductors 30*a*, 30*a'*; 30*b*, 30*b'* extend from the electrodes 20*a*; 20*b* through the end portions 12*a*; 12*b* to outside the discharge vessel 10. The current supply conductors 30*a*, 30*a'*; 30*b*, 30*b'* are connected to respective contact pins 31*a*, 31*a'*; 31*b*, 31*b'* which are fastened to lamp caps 32*a*; 32*b*. An electrode ring (not shown in FIG. 1) is usually arranged around each electrode 20*a*; 20*b* with a glass capsule clamped thereon, by means of which mercury was dosed. In an alternative embodiment, an amalgam comprising mercury and a PbBiSn or BiIn alloy is provided in an exhaust tube which is in communication with the discharge vessel 10.

Figure 2:
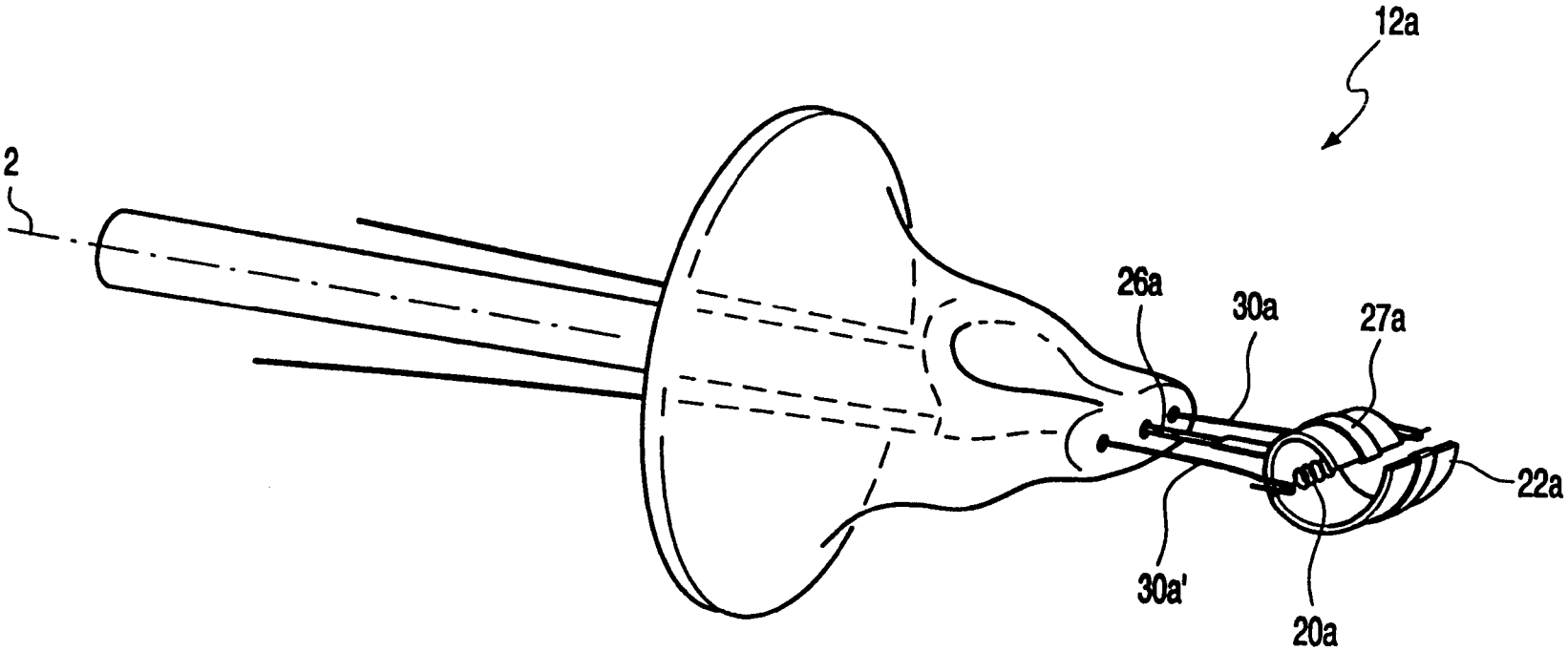
FIG. 2 shows a detail of FIG. 1 in perspective view.
Figure 3A:
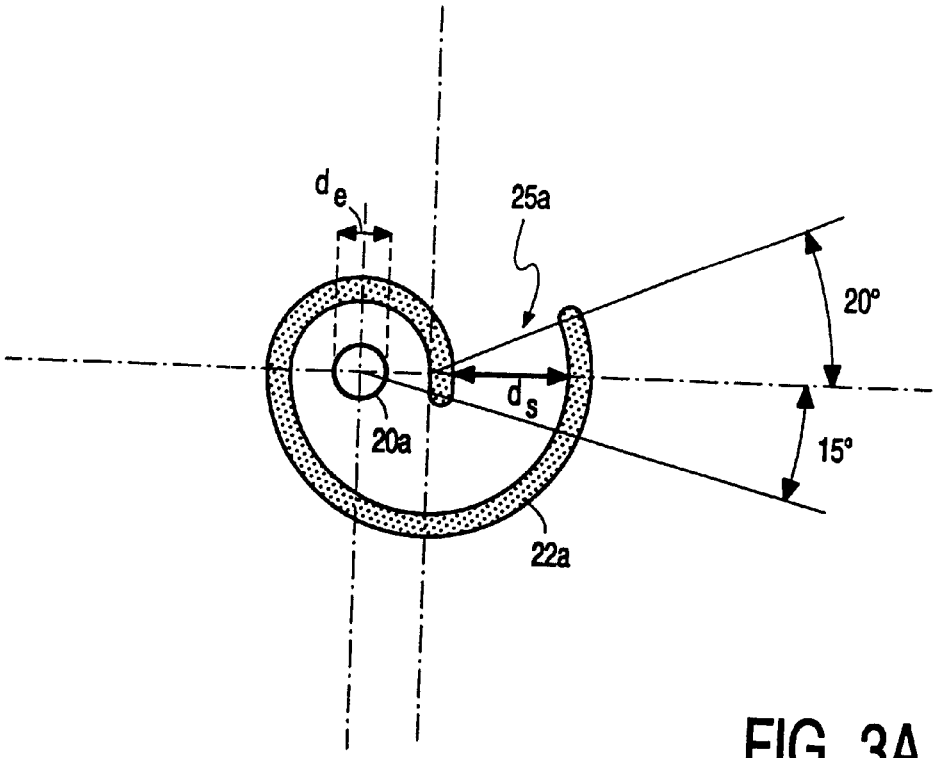
FIG. 3A is a cross-sectional view of the snail shell type electrode shield of FIG. 2.
Figure 3B:
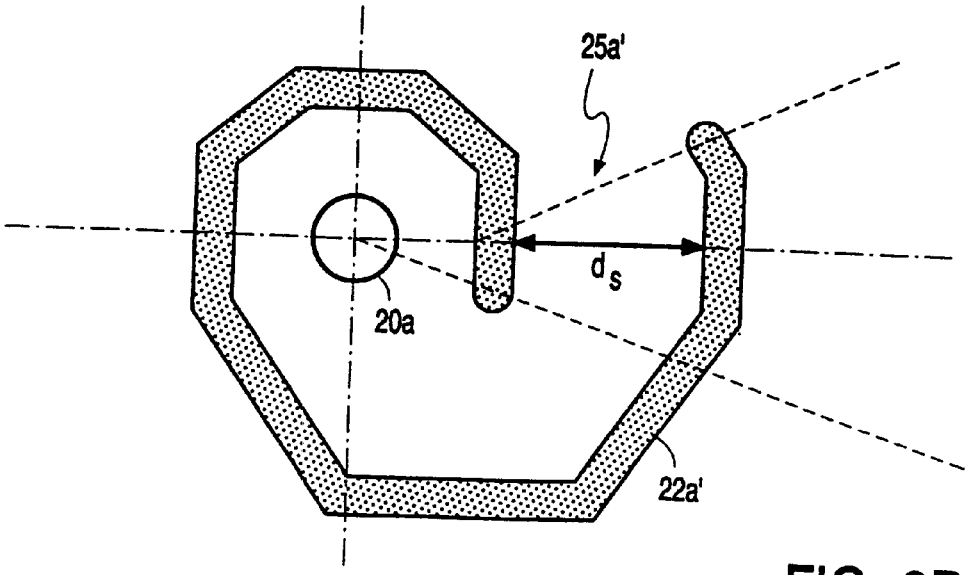
FIG. 3B is a cross-section of an alternative embodiment of the snail shell type electrode shield of FIG. 3A.

In the embodiment of FIG. 1, the electrode 20*a*; 20*b* is surrounded by an electrode shield 22*a*; 22*b* which according to the invention has the shape of a snail shell (depicted highly diagrammatically). FIG. 2 shows a detail of FIG. 1 in perspective view, where the end portion 12*a* supports the electrode 20*a* by means of the current supply conductors 30*a*, 30*a'*. Around the electrode 20*a* there is a snail shell type electrode shield 22*a* which is supported by fastening means 27*a*, which are retained in the end portion 12*a* by support means 26*a*. FIG. 3A shows a cross-section of the snail shell type electrode shield 22*a* of FIG. 2. The electrode 20*a* is depicted highly diagrammatically here as a portion of a winding having an outer circumference indicated with $d_e$. The snail shell type electrode shield 22*a* has a narrow opening indicated with $d_s$. In the alternative embodiment shown in FIG. 3B, the snail shell type electrode shield 22*a'* has (regular) polygonal shapes. Alternative embodiments of the snail shell comprise electrode shields of substantially cubic or hexagonal shapes. At the side of the discharge lamp facing the discharge, the electrode shield 22*a*, 22*a'* is provided with a lateral narrow opening 25*a*, 25*a'* with a dimension indicated with $d_s$. In a particularly preferred embodiment, the electrode 20*a* has an outer diameter $d_e$=1.8 mm, and the dimension of the opening $d_s \geqq 1.8$ mm, preferably, $d_s$ is at least substantially equal to 2 mm.

The snail shell type electrode shield reduces the risk of (emitter) material from the electrode being deposited on the inside wall of the discharge vessel and causing undesirable blackening there. When such an electrode shield is manufactured from a ceramic material (for example, densely sintered aluminum oxide), it is furthermore achieved that (emitter) material deposited on the ceramic electrode shield during operation of the low-pressure mercury vapor discharge lamp has such a high temperature that the material is incapable of forming mercury amalgams, whereby a considerable further reduction of the mercury consumption of the lamp is achieved.

Figure 4:
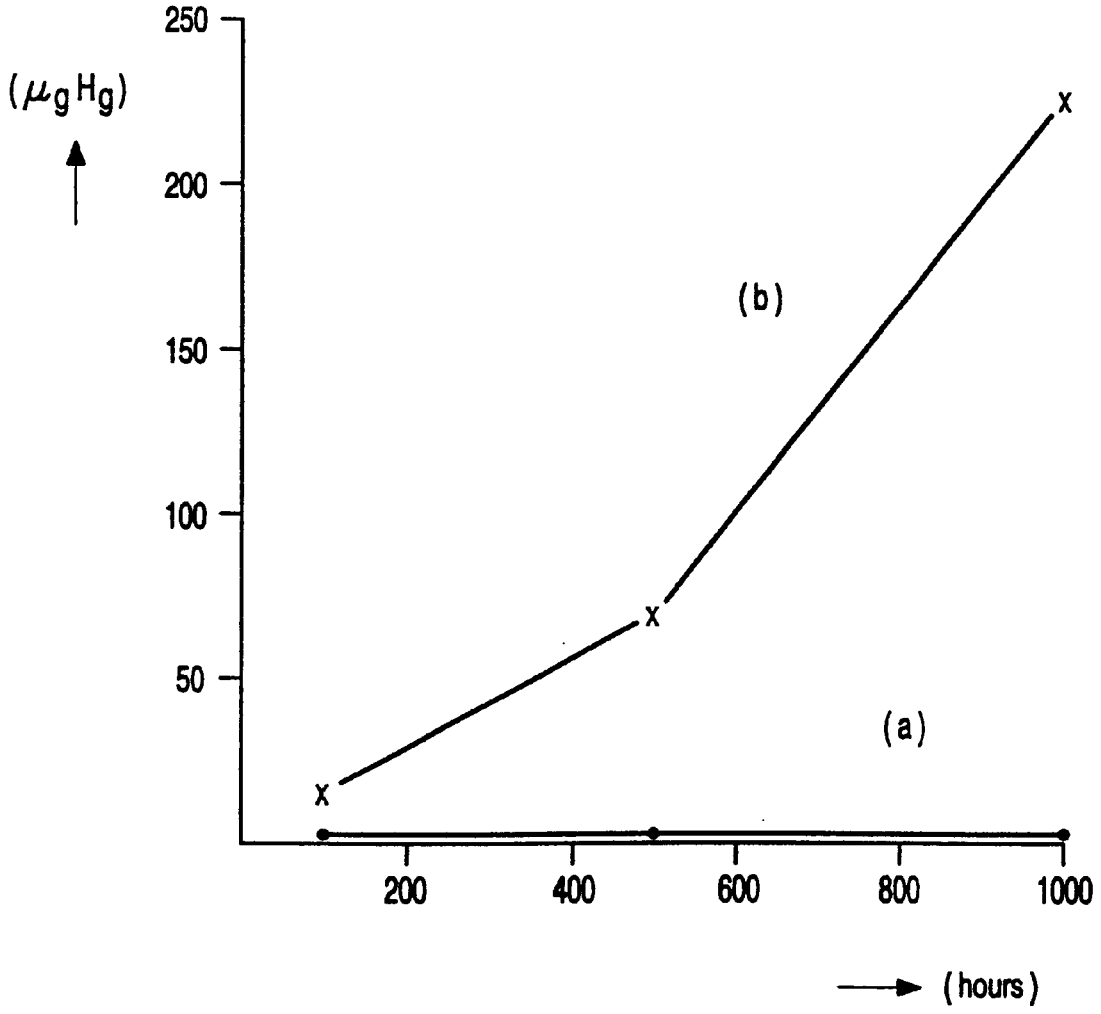
FIG. 4 shows the mercury consumption of a low-pressure mercury vapor discharge lamp with an electrode shield according to the invention and operated on a dimmed ballast with a so-called long cycle compared with the mercury consumption of a known discharge lamp.

Experiments were carried out during which low-pressure mercury vapor discharge lamps provided with snail shell type electrode shields according to the invention were operated on a so-called high-frequency regulating (HFR) dimming ballast, and the mercury consumption was measured in the area of the electrode and compared with that of a reference lamp provided with the known electrode shield. FIG. 4 shows the mercury consumption as a function of the number of hours of operation of low-pressure mercury vapor discharge lamps having snail shell type electrode shields manufactured from densely sintered aluminum oxide and provided each with a layer of $Fe_2O_3$, each electrode shield being provided around the electrode, as compared with the mercury consumption of a known discharge lamp. The discharge lamps were operated on a dimmed ballast here for 1250 hours in a so-called long switching cycle of 165 minutes ON alternating with 15 minutes OFF. The electrode fitted with a snail shell type electrode shield of aluminum oxide coated with a layer of $Fe_2O_3$ showed a mercury consumption in the area of the electrode (measured for each electrode) of 7 $\mu$g (curve a') after 1000 hours of operation, whereas the known lamp showed a mercury consumption in the area of the electrode of 225 $\mu$g (curve b'). It is apparent from this comparison that known discharge lamps consume considerably more mercury during life than do discharge lamps fitted with electrode shields according to the invention.

It will be obvious that many variations are possible to those skilled in the art within the scope of the invention. The shape of the discharge vessel need not necessarily be elongate and tubular, but may also be different. In particular, the discharge vessel may have a bent shape (for example, a meandering shape). The compact construction of the electrode shield makes it possible to utilize the invention to advantage in compact fluorescent lamps. Furthermore, the snail shell may alternatively be composed from several parts.

The invention resides in each novel characteristic and in any combination of characteristics.

What is claimed is:

1. A low-pressure mercury vapor discharge lamp provided with a discharge vessel, which discharge vessel surrounds in a gastight manner a discharge space provided with a filling of mercury and a rare gas, electrodes being arranged in the discharge space for generating and maintaining a discharge in the discharge space, and an electrode shield surrounding at least one of the electrodes at least substantially, the electrode shield forming a coil, the coil having a substantially spiral-shaped cross-section with an open space between an inner wall and an outer wall, said electrode being within said coil of the electrode shield.

2. A low-pressure mercury vapor discharge lamp provided with a discharge vessel, which discharge vessel has a longitudinal axis and encloses in a gastight manner a discharge space provided with a filling of mercury and a rare gas, electrodes for generating and maintaining a discharge in the discharge space, at least one of the electrodes having an electode shield and being arranged in the discharge space with a length transverse to the longitudinal axis, and the electrode shield enclosing the shielded electrode on a first side of the electrode which faces another of the electrodes and a second side of the electrode which is opposite the first side, and wherein the electrode shield has a substantially spiral-shaped cross-section.

3. A low-pressure mercury vapor discharge lamp as in claim 2 wherein the electrode shield is wound into a spiral which comprises at least one full revolution.

4. A low-pressure mercury vapor discharge lamp as claimed in claim 3, wherein the electrode shield has a narrow opening, the size of said opening being adapted so as to allow the electrode to pass through.

5. A low-pressure mercury vapor discharge lamp as claimed in claim 2 wherein at least one electrode comprises an alkaline earth metal which is partly released from the electrode during operation, and in that the electrode shield comprises a material which reacts with or forms an alloy with the alkaline earth metal originating from the at least one electrode.

6. A low-pressure mercury vapor discharge lamp as claimed in claim 5, wherein the material of the electrode shield comprises an oxide of a material which oxidizes the alkaline earth metal.

7. A low-pressure mercury vapor discharge lamp as claimed in claim 6, wherein the alkaline earth metal is barium or strontium, and the oxide is chosen from the group formed by $MnO_2$, $TiO_2$, $Fe_2O_3$, $In_2O_3$, $SnO_2$, $SnO_2$:Sb, $ZrO_2$, $Nb_2O_5$, $V_2O_5$, $Tb_4O_7$, and ZnO.

8. A low-pressure mercury vapor discharge lamp as claimed in claim 2 wherein the electrode shield is manufactured from a ceramic material.

9. A low-pressure mercury vapor discharge lamp as claimed in claim 2 wherein a temperature of the electrode shield is higher than 250° C. during operation.

10. A low-pressure mercury vapor discharge lamp as claimed in claim 2 wherein the electrode shield surrounds sides of the shielded electrode which face toward and away from said another of the electrodes.

11. A low-pressure mercury vapor discharge lamp as claimed in claim 2 wherein the electrode shield further encloses the shielded electrode on a third side and a fourth side of the electrode which are transverse to said first and second sides and parallel to the length of the shielded electrode.

12. A low-pressure mercury vapor discharge lamp provided with a discharge vessel, which discharge vessel surrounds in a gastight manner a discharge space provided with a filling of mercury and a rare gas, electrodes being arranged in the discharge space for generating and maintaining a discharge in the discharge space, and an electrode shield surrounding at least one of the electrodes at least substantially, wherein the electrode shield has a substantially spiral-shaped cross-section, and wherein the electrode shield surrounds sides of said at least one of the electrodes which face toward and away from another of said electrodes.

13. A low-pressure mercury vapor discharge lamp comprising:

a discharge vessel having side walls along a longitudinal axis of the discharge vessel, said discharge vessel enclosing a discharge space having a filling configured to facilitate a discharge in the discharge space;

at least one electrode for generating and maintaining the discharge in the discharge space; and a cylindrical shield having a substantially spiral-shaped cross-section and surrounding the electrode, wherein said cylindrical shield has open ends facing said side walls.

14. A low-pressure mercury vapor discharge lamp as claimed in claim 13 wherein the cylindrical shield surrounds sides of said at least one electrode which face toward and away from another said at least one electrode.

15. A low-pressure mercury vapor discharge lamp provided with a discharge vessel, which discharge vessel has an inside wall and encloses in a gastight manner a discharge space provided with a filling of mercury and a rare gas, electrodes for generating and maintaining a discharge in the discharge space, at least one of the electrodes including an emitter material and having an electrode shield, wherein the emitter material is substantially blocked from view by the electrode shield as viewed from the inside wall of the discharge vessel, and wherein the electrode shield has a substantially spiral-shaped cross-section.

16. A low-pressure mercury vapor discharge lamp as claimed in claim 15 wherein the electrode shield surrounds sides of the shielded electrode which face toward and away from another one of the electrodes.

17. A low-pressure mercury vapor discharge lamp as claimed in claim 15 wherein the emitter material comprises an alkaline earth metal and the electrode shield is manufactured from a ceramic material.

* * * * *